US007396446B2

(12) United States Patent
Mawston

(10) Patent No.: US 7,396,446 B2
(45) Date of Patent: Jul. 8, 2008

(54) MAGNESIUM ANODISATION METHODS

(75) Inventor: Ian Grant Mawston, Auckland (NZ)

(73) Assignee: Keronite International Limited, Cambridge (GB)

( * ) Notice: Subject to any disclaimer, the term of this patent is extended or adjusted under 35 U.S.C. 154(b) by 609 days.

(21) Appl. No.: 10/486,696

(22) PCT Filed: Aug. 14, 2002

(86) PCT No.: PCT/NZ02/00156

§ 371 (c)(1),
(2), (4) Date: Jun. 25, 2004

(87) PCT Pub. No.: WO03/016596

PCT Pub. Date: Feb. 27, 2003

(65) Prior Publication Data

US 2004/0238368 A1 Dec. 2, 2004

(30) Foreign Application Priority Data

Aug. 14, 2001 (NZ) ..... 512701

(51) Int. Cl.
*C25D 11/02* (2006.01)

(52) U.S. Cl. ..... 205/108; 205/210; 205/213; 205/321; 205/326

(58) Field of Classification Search ..... 205/321
See application file for complete search history.

(56) References Cited

U.S. PATENT DOCUMENTS

| | | | | |
|---|---|---|---|---|
| 4,076,598 | A * | 2/1978 | Lerner et al. | 205/250 |
| 4,439,287 | A * | 3/1984 | Birkle et al. | 205/108 |
| 4,744,872 | A | 5/1988 | Kobayashi et al. | |
| 4,820,436 | A * | 4/1989 | Andree et al. | 510/309 |
| 4,898,651 | A * | 2/1990 | Mahmoud | 205/206 |
| 4,976,830 | A | 12/1990 | Schmeling et al. | |
| 4,978,432 | A * | 12/1990 | Schmeling et al. | 205/108 |
| 5,102,456 | A * | 4/1992 | Jagannathan et al. | 106/1.26 |
| 5,385,602 | A | 1/1995 | Keough et al. | |
| 5,792,335 | A * | 8/1998 | Barton | 205/321 |
| 5,811,194 | A | 9/1998 | Kurtze et al. | |
| 5,837,117 | A | 11/1998 | Allegret | |
| 6,051,322 | A | 4/2000 | Kakizaki et al. | |
| 6,291,076 | B1 | 9/2001 | Nakatsugawa | |
| 6,319,819 | B1 | 11/2001 | Bessere et al. | |
| 6,335,099 | B1 | 1/2002 | Higuchi et al. | |
| 6,596,150 | B2 | 7/2003 | Nishino et al. | |
| 2003/0000847 | A1 * | 1/2003 | Ostrovsky | 205/321 |

FOREIGN PATENT DOCUMENTS

| | | |
|---|---|---|
| DE | 19800035 | 7/1999 |
| EP | 090632 | 4/1999 |
| WO | 98/42892 A1 | 10/1998 |
| WO | WO0044557 | 8/2000 |
| WO | 02/28838 A2 | 4/2002 |

OTHER PUBLICATIONS

F. A. Lowenheim, Electroplating, McGraw-Hill Book Company, New York, 1978, pp. 99.*
Hackh's Chemical Dictionary, fourth edition, Julius Grant, edifor, McGraw-Hill Book Company, New York,1969, pp. 514, 605.*

* cited by examiner

*Primary Examiner*—Susy Tsang-Foster
*Assistant Examiner*—William T Leader
(74) *Attorney, Agent, or Firm*—Lowe Hauptman Ham & Berner LLP

(57) ABSTRACT

This invention relates to a method of anodising magnesium material which includes anodising the magnesium while it is immersed in an aqueous electrolyte solution having a pH above 7, and in the presence of a phosphate, the electrolyte solution also containing a sequestering agent. The method may further include the provision of a plasma suppressing substance within the electrolyte solution. Furthermore, the electrolyte solution may also preferably include a tertiary amine such a TEA, and the current passed through the electrolyte solution may preferably be a straight DC current.

25 Claims, No Drawings

MAGNESIUM ANODISATION METHODS

TECHNICAL FIELD

This invention relates to magnesium anodising systems and methods. Throughout this specification, the terms "magnesium", "magnesium metal" and "magnesium material", may be used interchangeably, and are all to be understood to refer to or include magnesium metal and/or magnesium alloy (s) and/or mixtures thereof, and/or any articles or compounds comprising or including magnesium.

BACKGROUND ART

Magnesium is a very light, yet strong metal and is finding increasing acceptance for metal die castings, particularly where weight savings are desired. In addition, its property of shielding electromagnetic radiation is causing it to be of interest as a replacement for plastics in applications such as computers and mobile telephones. However, it is a reactive metal and corrosion, whether general or by galvanic effects, is a major problem.

A number of methods for applying a protective anodic oxide film on magnesium material have been available. These have sought to imitate the well established processes available for coating aluminium and its alloys, however achieving the same result on magnesium articles has been extremely difficult.

The anodisation of aluminium and its alloys is often conducted in sulphuric acid in which the oxide layer formed is slightly soluble. As the film builds outwards from the metal substrate, its rate of build decreases, so ultimately there is an equilibrium point at which the rate of dissolution is equal to that of further film growth. The dissolution of the film causes the formation of pores through which the ionic migration necessary to the electrochemical oxidation of the metal takes place. Without these pores only very thin films would be possible. After the electrochemical oxidation process is complete, the pores are scaled. Sealing of anodised aluminium can be achieved with hot water or simple inorganic chemical solutions.

Clearly an analogous process involving magnesium would attempt to simulate these features. However, because of the tendency of the forming film to crack and break due to the imposed tensile stresses, there are complications. Also, the use of an acidic solution to anodise magnesium is fraught with serious difficulties as magnesium is rapidly attacked by most common acids. Therefore, anodisation of magnesium should preferably take place in alkaline solutions.

One method of anodising magnesium relies on this property to create a rough, very porous layer which may form a base for paint or other surface coatings to be applied afterwards. Commonly, such an anodic film may be formed in an electrolyte of high pH, containing alkali hydroxides. The process proceeds by means of sparking, which sparking forms a sintered ceramic oxide film as the metal substrate is coated.

However, the forming of a sintered ceramic oxide film, through sparking, is not always desirable as the film is often brittle, uneven, and/or lacks uniformity.

A number of proprietary methods for anodisation of magnesium exist which seek to avoid this problem and hence create a stronger and/or more uniform film.

In PCT/NZ96/00016 (WO 96/28591) (Barton) there is disclosed a viable procedure for anodising magnesium or magnesium alloys. It involves anodising the material in an ammonia containing electrolyte solution. The presence of some phosphate compounds in the solution is also disclosed. Enhancements of such a Barton procedure are disclosed in PCT/NZ98/00040 (WO98/42892) (MacCulloch et al).

For environmental reasons arising from the emanation of ammonia and also taking into account potential problems associated with the disposal of ammonia-containing electrolytes and process washings, a process is desirable beyond those aforesaid where no ammonia or ammonium salts are present in the electrolite. However, the absence of ammonium compounds imposes difficulties in the functioning of the process in the areas of anodic polarisation, repeatability and film quality.

In PCT/NZ01/00215 (WO 02/28838 A2) there is disclosed another viable procedure for anodising magnesium or magnesium alloys which do away with ammonia-containing electrolytes. This method includes anodising the magnesium material while it is immersed in an aqueous electrolyte solution having a pH above 9, and in the presence of a phosphate (or phosphate ions). The solution also preferably includes a buffering agent such as a tetra-borate to maintain the pH of the solution above 9. There are also described pre-treatment steps prior to anodising.

Whilst the methods and apparatus described in PCT/NZ01/00215 result in a viable procedure for anodising magnesium, the solutions contain boron (or a borate) which is not always desirable as it can be environmentally harmful if not disposed of properly after use. Furthermore, some of the pre-treatment steps described are somewhat involved. It would therefore be desirable if there was a viable procedure for anodising magnesium or magnesium alloys which used an electrolyte that preferable did not contain ammonia and/or boron/borate and/or did not require the use of such involved pre-treatment step(s).

Furthermore, many procedures for anodising magnesium necessarily involve the use of a pulsed DC current, which requires the use of specialised and expensive rectifiers. It would also be desirable therefore if there was available a viable procedure which produced the required or desired results using straight or flat waveform DC (referred to herein as "straight DC").

It is therefore an object of the present invention to address the foregoing problems or at least to provide the public with a useful choice.

Further aspects and advantages of the present invention will become apparent from the ensuing description that is given by way of example only.

DISCLOSURE OF INVENTION

According to one aspect of the present invention there is provided a method of anodising magnesium material which includes anodising the magnesium material while it is immersed in an aqueous electrolyte solution having a pH above 7 and in the presence of a phosphate, the electrolyte solution also containing a sequestering agent.

According to another aspect of the present invention there is provided a method, substantially as described above, wherein the phosphate is an alkali metal phosphate.

According to another aspect of the present invention there is provided a method, substantially as described above, wherein the pH is in the range of 10.2-11.0.

According to another aspect of the present invention there is provided a method, substantially as described above, wherein the electrolyte solutions contains an alkali metal hydroxide.

According to another aspect of the present invention there is provided a method, substantially as described above, wherein the alkali metal hydroxide is KOH.

According to another aspect of the present invention there is provided a method, substantially as described above, wherein the electrolyte further includes a plasma suppressing substance.

According to another aspect of the present invention there is provided a method, substantially as described above, wherein the electrolyte further includes an amine.

According to another aspect of the present invention there is provided a method, substantially as described above, wherein the amine is TEA.

According to another aspect of the present invention there is provided a method, substantially as described above, wherein the sequestering agent is in the form of ethylene diamine tetramethylene phosphonic acid.

According to another aspect of the present invention there is provided a method, substantially as described above wherein the current passed through the electrolyte solution is a pulsed DC current.

According to another aspect of the present invention there is provided a method, substantially as described above, wherein the current passed through the electrolyte solution is a straight DC current.

According to another aspect of the present invention there is provided a method, substantially as described above, wherein the anodising of the magnesium material follows a pre-treatment designed to prepare the magnesium material for anodisation.

According to another aspect of the present invention there is provided a method, substantially as described above, wherein the anodising of the magnesium material follows one or more of the pre-treatment steps described in WO 02/28838 A2.

According to another aspect of the present invention there is provided a method of anodizing magnesium material, substantially as described above, wherein the anodizing of the magnesium material follows a pre-treatment designed to prepare the magnesium material for anodization.

According to another aspect of the present invention there is provided a method, substantially as described above, wherein the pre-treatment includes one or more of the following sub-steps:

(a) a cleaning step, (b) an etching step, (c) a surface activation step.

According to another aspect of the present invention there is provided a method, substantially as described above, wherein there is a cleaning step before and after the etching step.

According to another aspect of the present invention there is provided a method, substantially as described above, wherein the cleaning step includes an immersion of the magnesium material into a solution containing caustic soda.

According to another aspect of the present invention there is provided a method, substantially as described above, wherein the etching step includes an immersion of the magnesium material into a solution containing at least one acid.

According to another aspect of the present invention there is provided a method, substantially as described above, wherein the acid is nitric acid or phosphoric acid.

According to another aspect of the present invention there is provided a method, substantially as described above, wherein the etching step includes an immersion of the magnesium material into a solution containing DEOXALUME®

According to another aspect of the present invention there is provided a method, substantially as described above, wherein the surface activation step includes an immersion of the magnesium material into a solution containing a source of fluoride ions.

According to another aspect of the present invention there is provided a method, substantially as described above, wherein the surface activation step includes an immersion of the magnesium material into a solution containing a source of fluoride ions and an acid.

According to another aspect of the present invention there is provided a method, substantially as described above, wherein the surface activation step includes an immersion of the magnesium material into a solution containing potassium fluoride and nitric acid or phosphoric acid.

According to another aspect of the present invention there is provided a method, substantially as described above, wherein the surface activation step includes an immersion of the magnesium material into a solution containing ammonium bifluoride.

According to another aspect of the present invention there is provided a method, substantially as described above, wherein the surface activation step includes an immersion of the magnesium material into a solution containing DEOXALUME®.

According to another aspect of the present invention there is provided a method, substantially as described above, wherein between each substep there is optionally a rinsing step.

Generally speaking, the methods described in Barton and MacCulloch do not usually require a thorough cleaning of the magnesium metal prior to the anodization process. This is because the electrolytes described in Barton and MacCulloch contain ammonia, which is very effective in an electrolyte solution for the purposes of anodizing magnesium material regardless (to a certain extent) of the cleanliness of the magnesium material prior to anodizing.

We have found that by pre-treating the magnesium material, prior to anodization, we are able to achieve a virtually equivalent result as regards the quality of the anodic film formed (as regards -uniformity, strength and evenness etc) as the processes described in Barton and MacCulloch, but without requiring ammonia to be present in the electrolyte. This is desirable given that we are no longer faced with the environmental/health problems associated with using and disposing of ammonia containing electrolytes, as described previously.

Generally speaking, surface cleaning and preparation of metal substrates for an electro chemical process is a complex field and the pre-treatments presented below are therefore given by way of example only. Moreover, in some situations where components are heavily soiled, for example with die lubricants, or have surface corrosion, special cleaning steps additional or alternative to those listed herein may be required. Alternatively, good quality components with clean surfaces may require fewer or less rigorous cleaning steps.

The at least one pre-treatment steps described above as (a), (b), (c) may be undertaken in any order and/or may be repeated as required or as desired, or as dictated by the condition of the magnesium material to be pre-treated and subsequently anodized. Furthermore, and again depending upon the condition of the magnesium material, only one or two (or three) of the pretreatment sub-steps may be utilized.

Preferably, the cleaning step may be followed by the etching step, and subsequently followed by the surface activation step. Alternatively, or additionally, there may be provided an additional cleaning step after, the etching step, but prior to the surface activation step.

The cleaning step may involve the immersion of the magnesium material into an appropriate cleaning solution.

Preferably, the cleaning step may involve the immersion of the magnesium material into a solution which includes caustic soda. Any suitable concentration may be utilized as required or as desired, or as dictated by the condition of the magnesium material to be cleaned.

Preferably, the caustic soda may include sodium hydroxide at a concentration of between 10-50% w/v. A concentration of approximately 30% w/v may be particularly suitable.

The magnesium material may be immersed in the cleaning solution for any length of time, as required or as desired, or as dictated by the condition of the magnesium material. Preferably, the immersion time may be between 2-12 minutes, with approximately 5 minutes being particularly suitable.

The caustic soda solution may be at any suitable temperature, as required or as desired, or as dictated by the condition of the magnesium material. Preferably, the solution may be at a temperature of between 50-95° C., with a range of 70-85° C. being particularly suitable.

Preferably, after the cleaning step the magnesium material may be rinsed, and preferably with water. De-ionized water may be particularly suitable.

The etching step may preferably include the immersion of the magnesium material into a solution containing at least one acid. Any suitable acid or acids may be utilized as required or as desired. Examples include nitric acid and phosphoric acid.

Any suitable concentrations of acid may be utilized as required or as desired. For example, if the acid used is nitric acid, it may preferablybe of a concentration of approximately 0.4-0.8 M, with a particularly suitable range being 0.5-0.6 M.

Alternatively, the magnesium material may be immersed into a solution containing DEOXALUME®. which is a proprietary product manufactured by Henkel Corporation. If DEOXALUME®. is used, it may preferably be diluted to, approximately a 10% concentration.

The etching step serves to remove surface layers of the magnesium material which assists in the anodization process.

The magnesium material may be immersed in the etching solution for any length of time, as required or as desired or as dictated by the state of the magnesium material. For example, if phosphoric acid or nitric acid were to be used a time of approximately 30 seconds to 4 minutes may be suitable. If DEOXALUME® is used, a time of approximately 10-30 seconds may be suitable.

Similarly, the temperature of the etching solution may be in the range of 10-80° C., with a range of approximately 20-40° C. being particularly suitable.

Preferably, the magnesium material may be rinsed after the etching step, and preferably with water. De-ionized water may be particularly suitable.

Preferably, a further cleaning step, substantially as described previously, may be undertaken after the etching step, and preferably a further rinsing of the magnesium material, for example with de-ionized water, may follow the second cleaning step.

In this specification, the term "phosphate" is understood to include or refer to, collectively or singularly, either a phosphate or a source of phosphate ions. Furthermore, the term TEA is understood to refer to the tertiary amine Tri-ethanolamine.

The method of anodising magnesium material may include the step of anodising the magnesium material while it is immersed in an aqueous electrolyte solution having a pH above 7, and in the presence of a phosphate and a sequestering agent.

The phosphate may include an ortho-phosphate and/or a pyro-phosphate.

Any suitable source of phosphate may be utilised in the solution. For example, an alkali metal phosphate such as sodium dihydrogen ortho phosphate. Alternatively, or additionally, the phosphate may be provided by a phosphoric acid, or salt thereof.

Any suitable concentration of phosphate may be utilised as required or as desired, and experimental trial and error will enable the optimum or desired range of concentration to be ascertained. In general terms however phosphate concentrations of the order of 0.02M to 0.1M may be particularly suitable. It Is to be understood and appreciated that this range is given by way of example only, and concentrations of phosphate outside this range is also within the scope of the present invention.

The pH may preferably be greater than 9, and, more specifically, a pH in the range of 10.2-11+ is found to be particularly suitable.

Any suitable base may be utilised to reach and maintain the desired pH. For example, the electrolyte solution may be provided with a source of hydroxide ions, for example an alkali metal hydroxide such as KOH or NaOH.

Any suitable concentrations of base may be utilised as required in order to reach a preferred or desired pH.

The electrolyte solutions may also include a plasma suppressing substance. The role of the plasma suppressing substance is primarily to reduce the tendency for plasma discharges to form at defect sites on articles being anodised. An example of a suitable plasma suppressing substance may be an acrylic modification of maelic acid. A further example is the product P80.RTM., which is a compound manufactured by Cyanamid Corporation of the United States and which is a copolymer of allyl sulfonic acid and maleic anhydride, that is to say a polyacrylamide, as disclosed, for example in, U.S. Pat. No. 4,810,405 to Waller, et al. issued on Mar. 7, 1989, entitled Rust removal and composition thereof, and U.S. Pat. No. 5,062,962 to Brown et al. issued on Nov. 5, 1991, and entitled Methods of controlling scale formation in aqueous systems.

Any suitable amounts or concentrations of the plasma suppressing substance may be utilised as required or as desired. For example, a concentration in the range of 100 to 400 ppm may be suitable, although concentrations of the plasma suppressing substance outside of this range are also within the scope of the present invention.

The electrolyte solution may preferably include a sequestering agent. One role of the sequestering agent is to bind any loose or superfluous ions (usually metal ions) so that they cannot react and, for example, form white powder deposits and the like.

Furthermore, we have found that the use of a sequestering agent together with an amine such as TEA produces a surprising and advantageous result in that the anodisation of the magnesium material is found to proceed satisfactorily with only a straight DC current.

Any suitable sequestering agent ma)y be utilised, for example ethylene diamine tetramethylene phosphonic acid or DEQUEST® 2066 manufactured by Henkel Inc of the United States. Any suitable concentration range may be utilised and this may be determined by trial and experimentation. However, a concentration range of the order of 0.002M to 0.02M may be particularly suitable. Concentrations outside of this range are however also deemed to be within the scope of the present invention.

The electrolyte solution may also preferably include an amine, and more particularly a secondary or tertiary amine.

It is found that TEA is particularly suitable as it appears to work with the sequestering agent to produce the surprising result referred to previously.

Again, the concentration of the TEA may be any required or desired level, although a concentration in the range of 40-150 g/l may be particularly suitable. Again, a concentration outside of this range is also considered to be within the scope of the present invention.

The use of DC currents generally for anodising magnesium are well know and, for example, are described in considerable detail in WO 02/28838 A2.

The voltage applied to the electrolyte solutions may preferably be a direct current (DC). It is found that either a pulsed or a DC current may be suitable for use with the methods of the present invention. However, when the electrolyte solutions contains both an amine such as TEA and a sequestering agent such as DEQUEST® 2066 it is found that the anodisation of the magnesium material proceeds quite satisfactorily with just the use of straight DC current. This is of advantage and of commercial significance as a straight DC current does not require the use of expensive and/or specialised rectifiers and the like which are required to produce a pulsed current.

Preferably, the magnesium material may be pre-treated and or cleaned prior to the anodising of same. Any suitable pre-treatment and/or cleaning of the magnesium material may be utilised as required or as desired, or as dictated by the condition or state of the magnesium material. Preferably, and for example, the anodising of the magnesium material may follow one or more of the pre-treatment steps described in WO 02/28838 A2.

It is to be understood and appreciated however that the possible pre-treatment steps outlined in WO 02/28838 A2 are by no means the only possible pre-treatment processes or steps. For example, in situations where the magnesium material is heavily soiled with, for example, die lubricants or surface corrosion, additional or alternative cleaning or pre-treatment steps may be required and/or these steps may need to be repeated. Similarly, if the magnesium material is particulars clean and/or of good quality, it may require fewer or less rigorous cleaning or pre-treatment steps.

We have also found that the use of TEA and/or the sequestering agent allows less intensive pre-treatment or cleaning steps to be undertaken in order to prepare the magnesium material satisfactorily for the anodising process.

The types of apparatus and/or conditions under which magnesium material should preferably be anodised are well documented, for example the processes described in the prior art already referred to. However, a general overview of the apparatus and techniques to be utilised is as follows.

The anodic reaction takes place in a vessel in which the article to be anodised is connected to an electrically-conductive rack and immersed in the electrolyte. Generally, the rack will be coated in plastic except for small contact areas where it forms an electrical connection to the article being anodised. Where the rack is composed of a material that will passivate under the electrical conditions of tile anodising process, it is not necessary to coat the rack with an insulator, but it may be desirable to do so for improved efficiency.

In general it is advantageous for the vessel containing the electrolyte and the article to be anodised to be made of insulating plastic, provided that electrically conductive counter-electrodes are inserted in the tank, most commonly in the sides. It is desirable that these be inert chemically, preferably of stainless steel, type 316. Although it is possible to use counter-electrodes composed of alternative substances, for example, aluminium, this is undesirable since in another modification of the process, a reverse polarity voltage is applied to the article resulting in a brief, anodic polarisation. Stainless steel has the advantage of being inert under these conditions whereas aluminium would anodise, preventing the proper functioning of the standard cycle.

The electrolyte is operable over a broad temperature range, from around zero to its boiling point, but the process operates optimally over a range 20-60° C. The voltage applied to the electrolyte is normally direct current. The output produced by a rectified three phase power supply, comprising a voltage of constant polarity fluctuating by approximately 5% is suitable, as is smoothed DC. Modified waveforms, for instance, pulsed or superimposed AC voltages may also be employed although these result in different film thickness and other characteristics than that normally obtained from direct current anodisation.

When an anodic voltage is first applied to the article to be anodised the electrical resistance is low but this progressively increases as an insulating anodic film forms on the surface. The result is an increasing voltage when anodising current is held constant. The process is normally controlled by means of a constant current, preferably in the range 50 $A/m^2$ to 500 $A/m^2$ and optimally around 200 $A/m^2$. When operated at 200 $A/m^2$, the imposed voltage may be expected to reach 200 volts after two to three minutes, and for a commercially-useful coating, the voltage may reach an ultimate limit of 230 to 270 volts. Very thin films, suitable for some applications may be achieved using lower voltages. The film continues to build if the voltage is held constant on attaining a certain limit, for example, 220 volts, and as this takes place, the current dwindles.

Usually the process requires less than 5 minutes. As the voltage reaches a range of 200 to 270 volts, it is quite common for localised plasma discharges to form, particularly at defect sites. These plasmas are characterised by a changed coating morphology and possibly there are associated thermal effects on underlying metal structures. Suppression of the initiation of such plasma discharges has been achieved with the addition of the plasma suppressing substances referred to previously.

Since power supplies vary in their characteristics and the ultimate voltage achieved for an equivalent film thickness is highly dependent on aspects such as ripple percentage, the presence or absence of pulses and other electrical characteristics, the voltages stated above are nothing more than indications. The process is operable over a broad range of voltages and current densities.

In a modification of the standard process described in the foregoing paragraphs, a brief cathodic voltage may be applied to the article prior to anodisation. This is usually current controlled and results in a relatively low voltage, typically less than 20 volts, and considerable gassing from the article in the electrolyte. Such a cathodic cycle is not known to influence the chemical composition of the surface of the article to be anodised, but may assist with preparation of a clean and uniform surface for anodisation.

Since the market for magnesium or magnesium alloy articles is predominantly die cast components, the characteristics of articles that will be anodised is rather different to the aluminium market in which anodised components are often extruded or are flat profiles. Many die cast articles feature complex shapes and manifest extensive surface defects, including inclusions, porosity, flow marks and shapes that create difficulties for electrochemical processing by reason of air entrapment or flow stagnation.

It is desirable that the anodising electrolyte has efficient circulation both for reasons of maintaining uniform electrolyte composition and heat removal. Stagnant flow may be minimized by the use of ultrasonic cleaning devices during anodisation. The use of ultrasonic cleaning during anodisation results in a clean, smooth anodic film. It appears that ultrasonic energy reduces the boundary layer on the surface of the forming film and improves ionic transfer to the bulk electrolyte. There is an additional benefit in that loosely adherent particles, for example, inclusions in die cast components, are removed more readily.

Ultrasound use is not limited to the anodising electrolyte, and may also be used to improve rinse or cleaning process efficiency. However, the application of ultrasound to cleaning processes is well established in such processes.

Other means of improving electrolyte circulation where there may be problems associated with flow stagnation, or air pockets developing under submerged recesses, involve the use of flow adductors or racks with inbuilt rotation or movement cycles. These techniques are sometimes observed in other electrochemical processes. A rotary barrel system such as is commonly employed in electroplating or chemical plating processes is not suitable since the anodic film formed during the process disclosed herein is not electrically conductive.

A composite coating comprising many layers features many potential problems, including the expense of several processing stages and the accumulated probability of failure from each of those steps. Plainly it is desirable to achieve the final result in as few steps as possible. Since the overall production rate is determined by the cycle time of the slowest process, time savings in processing lead to efficiency gains overall.

The methods disclosed by Barton and MacCulloch are optimally conducted at temperatures lower than 10° C., thereby requiring the use of compressive refrigeration to remove waste heat from the process solution. This entails considerable capital expenditure and additional energy costs. For the purposes of the present invention, a cooling tower is sufficient for commercial production. The result is a significant saving.

A common problem encountered in anodising magnesium articles arises from the fact that many magnesium articles are die cast rather than extruded, forged or rolled. Die-castings frequently manifest a range of defects. These include porosity, cracks, flow lines, inclusions, plaques of externally solidified material and others. As a tool steel die ages defects arise from tool wear. Die-casting alloys are frequently heterogeneous, unlike the homogeneous solid solutions that are frequently used for extrusion.

Accordingly, unusual anodising behaviour at defect sites may sometimes occur. It is found that the sequestering agent, being added to the electrolyte solution, suppresses the tendency for white powder deposits to form.

In some embodiments of the present invention, the electrolyte solution may include a buffering agent to maintain the pH and the desired level or range. Any suitable buffering agent may be utilised, although a tetra-borate may be particularly suitable. Moreover, an alkali metal tetraborate such as sodium tetraborate may be particularly suitable.

BEST MODES FOR CARRYING OUT THE INVENTION

Some examples of best modes for carrying out the invention are described below.

1. An electrolyte was prepared as follows:
   Sodium dihydrogen orthophosphate ($NaH_2PO_4.2H2O$)—6 g/l
   Sodium tetraborate ($Na_2B_4O_7.5H_2O$)—30 g/l
   Sodium hydroxide (NaOH)—approx 10 g/l
   Ethylene diamine tetramethylene phosphonic acid ($C_6H_{16}O_{12}N_2P_4$)—3 g/l
   The phosphate salt was dissolved in deionised water, and the borate added slowly at a temperature of around 40° C. Sodium tetraborate pentahydrate, as used in this example, is quite slow to dissolve as there is a tendency for the formation of large, slow-to-dissolve crystals. The pH was then adjusted upwards to 11.0 by adding sodium hydroxide solution. Finally, the organic acid was added. Pre-cleaning steps comprising 2 minutes in 3.5% nitric acid at ambient temperature, 5 minutes in 25% NaOH solution at 80° C. and 5 minutes in 0.03M ammonium bifluoride at 40° C. Anodising was performed at 200 $A/m^2$, with the voltage starting from zero and rising to around 230 volts before the process was terminated. A uniform, smooth, powder-free film of about 3-4 μm thickness was formed on the surface of articles of the magnesium alloys AZ91D, AM60 and AZ31B.
2. An electrolyte was prepared as follows:
   Sodium dihydrogen orthophosphate ($NaH_2PO_4.2H_2O$)—6 g/l
   Sodium tetraborate ($Na_2B_4O_7.5H_2O$)—30 g/l
   Sodium hydroxide (NaOH)—approx 10 g/l
   Ethylene diamine tetramethylene phosphonic acid ($C_6H_{16}O_{12}N_2P_4$)—3 g/l
   Acrylic modified maleic acid (P80®, a proprietary compound of the Cyanamid Corporation, USA)—200 ppm
   The electrolyte was prepared as for example #1 above, with the P80® component added after the organic acid. Pre-treatments were as for the example above. The anodising was conducted at 200 $A/m^2$, with the voltage starting from zero and reaching about 250 volts. No tendency for plasma discharges was noticed even though poor quality die cast samples were deliberately chosen for the experiment. The anodic film was smooth and uniform, similar to that described above.
3. We then experimented with an electrolyte solution that had no boron or borates and instead used TEA. Specifically, the electrolyte contained:
   ortho-phosphate ions
   TEA
   A suitable base giving a pH above 10.

It was found that this process worked with only a caustic-based degreasing step as its pre-treatment. However, anodising in this electrolyte specifically required the use of a specified pulse DC current.

3. The deposited coating was $Mg_3PO_4$. An electrolyte was prepared as follows:

| | |
|---|---|
| Phosphoric acid 75% | 100 g/L |
| Triethanolamine 99% | 85 g/L |
| Potassium Hydroxide solution 45% | 210 g/L (pH = 11.2) |
| Conductivity | 70 mS at 20° C. |

Anodising was carried out at 200 $A/m^2$ at 45° C. using a pulsed waveform (10 ms on 10 ms off) for 3 min. The average voltage was 90 Volts with a peak voltage of 195 Volt.

The deposited anodic layer was a light grey and had a thickness of 14 um.

An attempt to anodise a magnesium test plate in the same electrolyte under the same conditions except that tile power supplied was continuous three phase, unfiltered, full wave, rectified current did not produce any meaningful polarisation of the anode and hence no film was deposited.

However, when 4 g/L of "DEQUEST 2066" was added to the same bath a further experiment showed that a good film of some 12-15 um could be deposited using an equivalent continuous DC current. Subsequently this solution with the DEQUEST® behaved in a similar way to Example 3 above, which used a pulsed current.

4. An electrolyte was prepared as follows:

| | |
|---|---|
| Phosphoric acid 85% | 90 g/L |
| Triethanolamine 99% | 90 g/L |
| Dequest 2066 | 2 g/L |
| Sodium Hydroxide | To achieve pH = 11.0 |
| Conductivity | 75 mS at 20° C. |

Anodising was carried out at 300 A/m$^2$ at 45° C. using filtered DC for 2 min. The average voltage was 70 Volts with an end voltage of 155 Volt. The deposited anodic layer was a light grey and had a thickness of 10 um.

Triethanolamine is a preferred tertiary amine as it is odourless, has good solubility, a high boiling point, and a satisfactory dissociation constant. Generally it has been observed that a high viscosity anodising solution is beneficial to film formation especially if this results from the employment of high molecular weight substituted tertiary or secondary amines. An example was the use of 75 g/L of 1-di-ethyl amino 2-propanol. The films produced were easily formed at low average voltage and at good current efficiency.

The addition of a small amount of a phosphonate such as "Dequest " 2066 or 2041 to the anodising bath allows the anodising process to proceed with both pulsed waveforms and also filtered and unfiltered DC.

The following pre-treatnielt scheme was applied to both AZ91 and AM50 alloys and was found to be beneficial in obtaining good polarnsation and an even coating.

a. Degrease in hot NaOH and detergent at 70° C. for 5 mins.

b. Rinse in water for 3 mins.

c. Soak in 2% ammonium bi-fluoride solution for 5 mins.

d. Water rinse.

Coating thickness and porosity can. to some degree, be controlled by choosing various combinations of both current density and time. For example, a high current density for a short time will produce a less porous film than a lower current density for a longer time given that the film thickness is the same in both cases.

When using pulsed waveforms similar to that shown in Example 3 the ratio of peak current to average current can be as high as 10:1. This could be disadvantageous in some cases as the power supply must be over-designed for relatively small average currents.

Potassium hydroxide is the preferred alkali.

A lower electrolyte pH in combination with the phosphonate additive was found to be beneficial in promoting anodic film formation on substrates that had had high aluminium content due to segregation. This was particularly so if fluoride pre-treatment was used.

As an alternative to the cathodic treating of the magnesium material prior to anodizing, the magnesium material may instead be pre-treated. The pre-treatment preferably includes the following steps, namely a cleaning step, an etching step, and a surface activation step.

Preferably, the magnesium material is first subjected to a cleaning step followed by the etching step, followed by a further cleaning step, and followed lastly by a surface activation step. Preferably, in between each of the steps as just described, there is a rinsing step involving the rinsing of the magnesium material with de-ionized water. This pre-treatment process is summarized in FIG. 2.

Some examples of best modes for carrying out the invention, utilizing the pre-treatment step, are 10 described below:

1. An electrolyte was prepared as follows:

Sodium dihydrogen orthophosphate ($Na_2H_2PO_4.2H_2O$)—6 g/l

Sodium tetra-borate $Na_2B_4O_7.5H_2O$—30 g/l

Sodium hydroxide (NaOH)—approx 10 g/l

The phosphate salt was dissolved in deionized water, and the borate added slowly at a temperature of around 40° C. Sodium tetra-borate pentahydrate, as used in this example, is quite slow to dissolve as there is a tendency for the formation of large, slow-to-dissolve crystals. The pH was then adjusted upwards to 11.0 by adding sodium hydroxide solution.

Pre-treatment steps were as follows:

(i) 5 minutes in 25% NaOH solution at 80° C.

(ii) Rinsing with de-ionized water.

(iii) 2 minutes in 3.5% nitric acid at ambient temperature.

(iv) Rinsing with de-ionized water.

(v) 5 minutes in 25% NaOH solution at 80° C.

(vi) Rinsing with de-ionized water.

(vii) 5 minutes in 0.03M ammonium bifluoride at 40° C.

(viii) Rinsing with de-ionized water.

Anodizing was then performed in the electrolyte described above at 200 A/m$^2$, with the voltage starting from zero and rising to around 230 volts before the process was terminated. The anodic film formed was smooth and uniform.

2. An electrolyte was prepared as follows:

Sodium dihydrogen orthophosphate ($Na_2H_2PO_4.2H_2O$)—12 g/l

Sodium tetra-borate $Na_2B_4O_7.5H_2O$—15 g/l

Sodium hydroxide (NaOH)—approx 15 g/l

The electrolyte was prepared as for the previous example. Pre-treatments were as for the previous example. The anodizing was conducted at 200 A/m$^2$, with the voltage starting from zero and reaching about 230 volts. A smooth, uniform film, similar to that described in example #1 above resulted.

Aspects of the present invention have been described by way of example only and it should be appreciated that modifications and additions may be made thereto without departing from the scope thereof, as defined in the appended claims.

The claims defining the invention are:

1. A method of anodizing magnesium material comprising:

anodizing the magnesium material while it is immersed in an aqueous electrolyte solution having a pH above 7 and in the presence of a phosphate, the electrolyte solution also containing ethylene diamine tetramethylene phosphonic acid as a sequestering agent used in combination with triethanolamine for binding any loose or superfluous ions so that they cannot react and form powder deposits.

2. A method as claimed in claim 1, wherein the phosphate includes an ortho-phosphate.

3. A method as claimed in claim 1, wherein the phosphate includes a pyro-phosphate.

4. A method as claimed in claim 1, wherein the phosphate is an alkali metal phosphate.

5. A method as claimed in claim 1, wherein the phosphate is in the form of, or is provided by, a phosphoric acid.

6. A method as claimed in claim 1, wherein the pH is greater than 9.

7. A method as claimed in claim 1, wherein the pH is in the range of 10.2-11.0.

8. A method as claimed in claim 1 wherein the electrolyte solutions contains an alkali metal hydroxide.

9. A method as claimed in claim 8, wherein the alkali metal hydroxide is KOH.

10. A method as claimed in claim 1 wherein the electrolyte further includes a plasma suppressing substance.

11. A method as claimed in claim 10, wherein the plasma suppressing substance comprises a polyacrylamide.

12. A method as claimed in claim 1, wherein the sequestering agent comprises ethylene diamine tetramethylene phosphonic acid.

13. A method as claimed in claim 1, wherein the current passed through the electrolyte solution is a pulsed DC current.

14. A method as claimed in claim 1, wherein the current passed through the electrolyte solution is a continuous DC current.

15. A method as claimed in claim 1, wherein the anodizing of the magnesium material follows a pre-treatment that prepares the magnesium material for anodization.

16. A method as claimed in claim 1, further comprising pretreating the magnesium material under conditions sufficient to prepare magnesium material for anodizing, and then anodizing said pretreated magnesium material.

17. A method as claimed in claim 16, wherein the pretreatment includes at least one of the following sub-step(s) selected from the group consisting of: (a) a cleaning step, (b) an etching step, and (c) a surface activation step.

18. A method as claimed in claim 17, further comprising carrying out a cleaning step before and after the etching step.

19. A method as claimed in claim 17, wherein the cleaning step includes an immersion of the magnesium material into a solution containing caustic soda.

20. A method as claimed in claim 17, wherein the etching solution comprises at least one acid.

21. A method as claimed in claim 20, wherein the acid is at least one member selected from the group consisting of nitric acid and phosphoric acid.

22. A method as claimed in claim 17, wherein the surface activation step includes immersion of the magnesium material into a solution containing a source of fluoride ions.

23. A method as claimed in claim 17, wherein the surface activation step includes immersion of the magnesium material into a solution containing potassium fluoride and at least one acid selected from the group consisting of nitric acid and phosphoric acid.

24. A method as claimed in claim 17, wherein the surface activation step includes immersion of the magnesium material into a solution containing ammonium bifluoride.

25. A method as claimed in claim 17, further comprising rinsing said magnesium material between each sub-step.

* * * * *